US010515575B2

(12) United States Patent
Fei et al.

(10) Patent No.: US 10,515,575 B2
(45) Date of Patent: Dec. 24, 2019

(54) BISTABLE DISPLAY AND DRIVING METHOD THEREOF

(71) Applicant: Schneider Electric Industries SAS, Rueil-Malmaison (FR)

(72) Inventors: Weihe Fei, Shanghai (CN); Fenglian Zhang, Shanghai (CN); Vivien Moliton, Grenoble (FR); Pierre Raulin, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 15/952,760

(22) Filed: Apr. 13, 2018

(65) Prior Publication Data

US 2018/0301073 A1 Oct. 18, 2018

(30) Foreign Application Priority Data

Apr. 14, 2017 (CN) ..... 2017 1 0243318

(51) Int. Cl.

*G09G 3/18* (2006.01)
*G09G 3/04* (2006.01)
*G09G 3/16* (2006.01)

(52) U.S. Cl.

CPC ..... *G09G 3/18* (2013.01); *G09G 3/045* (2013.01); *G09G 3/16* (2013.01); *G09G 2300/0426* (2013.01)

(58) Field of Classification Search

CPC combination set(s) only.
See application file for complete search history.

(56) References Cited

U.S. PATENT DOCUMENTS

2003/0214695 A1* 11/2003 Abramson ..... G02F 1/15 359/265
2007/0080928 A1* 4/2007 Ishii ..... G04G 9/12 345/107
2008/0212165 A1 9/2008 Jagt et al.
(Continued)

FOREIGN PATENT DOCUMENTS

JP 2010078762 4/2010

OTHER PUBLICATIONS

English Language Machine Translation of Japanese Patent Application Publication No. JP2010078762 dated Apr. 8, 2010, 21 pages.
(Continued)

*Primary Examiner* — Kwin Xie
(74) *Attorney, Agent, or Firm* — Locke Lord LLP

(57) ABSTRACT

A bistable display includes: an inner box constituted of a first substrate, a second substrate and a box body surrounding a space between the first substrate and the second substrate, a bistable display material is injected into the space, and one or more of a common electrode conductive layer, a pattern conductive layer, and a background conductive layer are respectively formed on the first substrate and/or the second substrate inside the inner box, and the common electrode conductive layer is led out of the inner box through a common electrode, the pattern conductive layer is led out of the inner box through a pattern electrode, and the background conductive layer is led out of the inner box through a background electrode.

6 Claims, 9 Drawing Sheets

(56) References Cited

U.S. PATENT DOCUMENTS

| | | | | |
|---|---|---|---|---|
| 2008/0273007 | A1* | 11/2008 | Ng | G02F 1/167 345/107 |
| 2011/0169805 | A1* | 7/2011 | Yamazaki | G09G 3/344 345/211 |
| 2012/0256893 | A1* | 10/2012 | Sakamoto | G09G 3/2003 345/208 |
| 2014/0362066 | A1* | 12/2014 | Huang | G09G 3/344 345/208 |
| 2016/0224175 | A1* | 8/2016 | Moon | G06F 3/0412 |

OTHER PUBLICATIONS

Extended European Search Report for European Patent Application No. 18305461.8 dated Jul. 19, 2018, 10 pages.

* cited by examiner (a)

(b)

(a)

(b)

BISTABLE DISPLAY AND DRIVING METHOD THEREOF

TECHNICAL FIELD OF THE DISCLOSURE

The present disclosure relates to a bistable display and a driving method thereof, and in particular to a dual-electrode driven bistable display and a driving method thereof.

BACKGROUND

There is a display application in the electrical switch protection circuit. When the circuit system fails, the display can indicate the type of the failure, and this indication state can be maintained in a power-off state, that is, the display can maintain the displayed pattern in the case when there is no power supply. Such display is named as bistable display. The entire display plane of the bistable display is treated as a pixel with being led out by two electrodes, and in this way it can be used as a bistable indicator light. Since it does not require power to maintain the indication, it is of high utility in electrical switch indications. As a functional extension of such display, we can print a pattern on the display, and a bistable indicator light with specific indication significance can be made out.

In order to make the bistable display display a specific pattern, currently there are two realization methods. The first one is to print a pattern on the surface of the display. As shown in FIG. 1(*a*), the color of the pattern is the same as the background color in the dark state of the display. The printed pattern can be thereby displayed when the display is in the bright state (the first stable state of the display). Its disadvantage is that since the bistable display has certain optical reflections in the dark state (the second stable state of the display), the actual effect of the printed pattern cannot be completely consistent with the background color of the display in the dark state, resulting in that the display can vaguely show the printed pattern even in a dark state and that the printed pattern has reliability risks such as breakage, peeling or the like. The second method is to lead out a separate pattern electrode in the display which composes, together with background electrode and display common electrode, a three-electrode input driving way, as shown in FIG. 1(*b*). Its disadvantage is that although it can improve the display effect of the pattern, due to one additional set of driver circuits, it is incompatible with the previous driver circuits and increases the cost of the driver circuits.

SUMMARY

The present disclosure has been made in view of the above problems. The purpose of the present disclosure is to propose an electronic design of a bistable display so that the display displays a specific pattern while still keeping the two electrodes led out without the need to print a pattern on the surface of the display, so as to improve the visual effect and the reliability of the display.

The present disclosure provides a bistable display, comprising: an inner box constituted of a first substrate, a second substrate and a box body surrounding space between the first substrate and the second substrate, wherein a bistable display material is injected into the space, and one or more of the common electrode conductive layer, the pattern conductive layer, and the background conductive layer are respectively formed on the first substrate and/or the second substrate inside the inner box, and the common electrode conductive layer is led out of the inner box through a common electrode, the pattern conductive layer is led out of the inner box through a pattern electrode, and the background conductive layer is led out of the inner box through a background electrode.

The above bistable display according to the present disclosure can make the pattern to be presented by the display be inside the display by using a pattern display layer inside the display, and thus has high reliability and has no problem such as pattern breakage, peeling or the like.

The above bistable display of the present disclosure further comprises: a common electrode terminal connected with the common electrode; and a signal electrode terminal connected with the background electrode and/or the pattern electrode, wherein a pulse signal including a pulse of a first voltage higher than a first stable state (a bright state) drive voltage of the display and a pulse of a second voltage lower than the first stable state drive voltage of the display but higher than the second stable state (the dark state) drive voltage of the display is applied between the common electrode terminal and the signal electrode terminal.

Due to having a dual-electrode driving structure, the above bistable display according to the present disclosure can be compatible with the original circuit without increasing the cost of the driver circuit and modifying the original driver circuit.

The above bistable display of the present disclosure connects the background electrode, the pattern electrode and the common electrode in series between the signal electrode terminal and the common electrode terminal through a voltage dividing component to form a voltage divider circuit, the voltage dividing component being comprised of one or more of an external capacitor, an internal capacitor, a resistor, and a voltage regulator tube.

Due to providing the driving signal, after being divided by using the voltage divider circuit formed in many ways, to each electrode, the above bistable display according to the present disclosure may produce many kinds of display effects by using one driving signal.

The above bistable display of the present disclosure directly applies the driving signal to one of the background electrode and the pattern electrode and applies the driving signal of a first divided voltage obtained after the voltage division by the voltage divider circuit to the other one of the background electrode and the pattern electrode, when a driving signal is applied between the common electrode terminal and the signal electrode terminal, and adjusts the value of the voltage dividing component in the voltage divider circuit and/or values of the first voltage and the second voltage so that the first divided voltage applied to the other one of the background electrode and the pattern electrode is lower than the first stable state drive voltage of the display and higher than the second stable state drive voltage of the display when the driving signal is the pulse of the first voltage, and the first divided voltage applied to the other one of the background electrode and the pattern electrode is lower than the first stable state drive voltage of the display and higher than the second stable state drive voltage of the display when the driving signal is the pulse of the second voltage.

The above bistable display according to the present disclosure may provide suitable voltages for respective electrodes by combining the voltage divider circuit and the voltage adjustment range of the driving signal.

The present disclosure further provides a driving method of a bistable display, for driving the above bistable display, the method comprising steps of: when a driving signal is applied between the common electrode terminal and the signal electrode terminal, directly applying the driving signal to one of the background electrode and the pattern electrode, and applying the driving signal of a first divided voltage obtained after the voltage division by the voltage divider circuit to the other one of the background electrode and the pattern electrode; and adjusting the value of the voltage dividing component in the voltage divider circuit and/or values of the first voltage and the second voltage so that the first divided voltage applied to the other one of the background electrode and the pattern electrode is lower than the first stable state drive voltage of the display and higher than the second stable state drive voltage of the display when the driving signal is the pulse of the first voltage, and the first divided voltage applied to the other one of the background electrode and the pattern electrode is lower than the first stable state drive voltage of the display and higher than the second stable state drive voltage of the display when the driving signal is the pulse of the second voltage.

The above driving method of the bistable display according to the present disclosure may provide suitable voltages for respective electrodes by combining the voltage divider circuit and the voltage adjustment range of the driving signal.

The present disclosure further provides a driving method of a bistable display, the method comprising steps of: directly connecting the signal electrode terminal with the first pattern electrode, and providing the voltage of the driving signal to the first pattern electrode directly; and providing the first divided voltage obtained after dividing the voltage of the driving signal by the first external capacitor to the second pattern electrode, and providing the second divided voltage obtained after dividing the voltage of the driving signal by the first external capacitor and the second external capacitor to the background electrode; and adjusting the values of the first external capacitor and the second external capacitor in the voltage divider circuit while dividing the voltage amplitude of the driving signal into 3 levels or more, and in a case that the voltage amplitude is of 3 levels, setting them as the first voltage, the third voltage and the second voltage respectively in the descending order with the third voltage being less than the first voltage and greater than the first stable state drive voltage of the display, so that it becomes one of the following three cases: when the driving signal is the pulse of the first voltage, the first voltage is directly applied to the first pattern electrode, the voltage applied to the second pattern electrode is lower than the first voltage but higher than the first stable state drive voltage of the display, and the voltage applied to the background electrode is lower than the first stable state drive voltage of the display and higher than the second stable state drive voltage of the display; when the driving signal is the pulse of the third voltage, the third voltage is directly applied to the first pattern electrode, the voltage applied to the second pattern electrode is lower than the first stable state drive voltage of the display and higher than the second stable state drive voltage of the display, and the voltage applied to the background electrode is lower than the first stable state drive voltage of the display and higher than the second stable state drive voltage of the display; or when the driving signal is the pulse of the second voltage, the second voltage is directly applied to the first pattern electrode, the voltage applied to the second pattern electrode is lower than the first stable state drive voltage of the display and higher than the second stable state drive voltage of the display, and the voltage applied to the background electrode is lower than the first stable state drive voltage of the display and higher than the second stable state drive voltage of the display.

Due to providing the driving signal, after being divided by using the voltage divider circuit formed in many ways, to each electrode, the above driving method of the bistable display according to the present disclosure may produce many kinds of display effects by using one driving signal and realize the display of two or more bistable patterns.

In summary, the present disclosure has the following characteristics:

1. Both the pattern display area and the background display area of the bistable display are composed of conductive layers inside the display. Two internal electrodes are respectively formed. The driving signal of the display is directly connected with one of the internal electrodes, and is indirectly connected with the other one of the internal electrodes through the voltage divider circuit. From the appearance point of view, there is only one signal input electrode, which composes a dual-electrode drive input way together with the other external electrode, i.e. the common electrode, of the display.

2. The voltage divider circuit as described above can have a variety of design methods. The present disclosure provides four voltage divider circuit implementation methods, which are an external capacitor method, an internal capacitor method, a voltage divider resistor method, and a voltage regulator tube method respectively.

3. Using the dual-electrode drive input way as described above in combination with the multi-level signal driving method, the display of two or more bistable patterns can also be realized.

TECHNICAL EFFECT

The disclosure can solve the technical problems of eliminating the unsatisfactory visual display effect of the current bistable displays due to using printed patterns and eliminating the potential risks such as falling, breakage or the like of the printed patterns, thereby play a role in improving the visual display effect of the display and improving the reliability of the display.

BRIEF DESCRIPTION OF THE DRAWINGS

From the following description of specific embodiments of the present disclosure taken in conjunction with the attached drawings, other advantages and features will become more clear and apparent. These specific embodiments are only for non-limiting purposes, and are shown in the attached drawings. In the attached drawings, the same reference numerals are used to denote the same components or units, in which.

DETAILED DESCRIPTION

Specific embodiments of the present disclosure will be described below in more detail with reference to the attached drawings. Although the attached drawings show multiple specific embodiments of the present disclosure, it should be understood that the present disclosure may be implemented in various forms and should not be limited by the embodiments described herein. Rather, these embodiments are provided so that this disclosure will be understood more thoroughly and completely, and the scope of the present disclosure may be fully conveyed to those skilled in the art.

First Embodiment

The first embodiment is an embodiment of a voltage divider circuit implementing the driving of the bistable displaying by using external capacitor method. In the following, the description will be made with reference to FIGS. 2 to 4.

Figure 1:
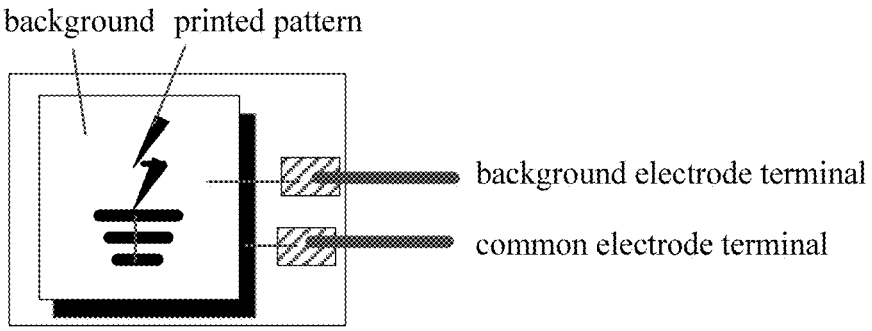
FIG. 1 is an pattern display method of an existing bistable display, in which FIG. 1(*a*) shows a pattern printing method and FIG. 1(*b*) shows a three-electrode method.
Figure 1:
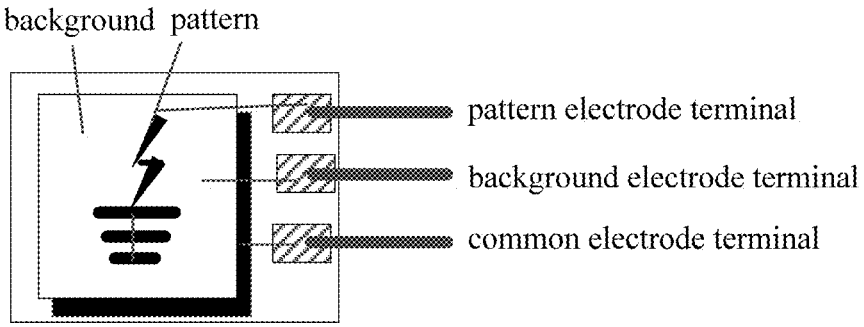
Figure 2:
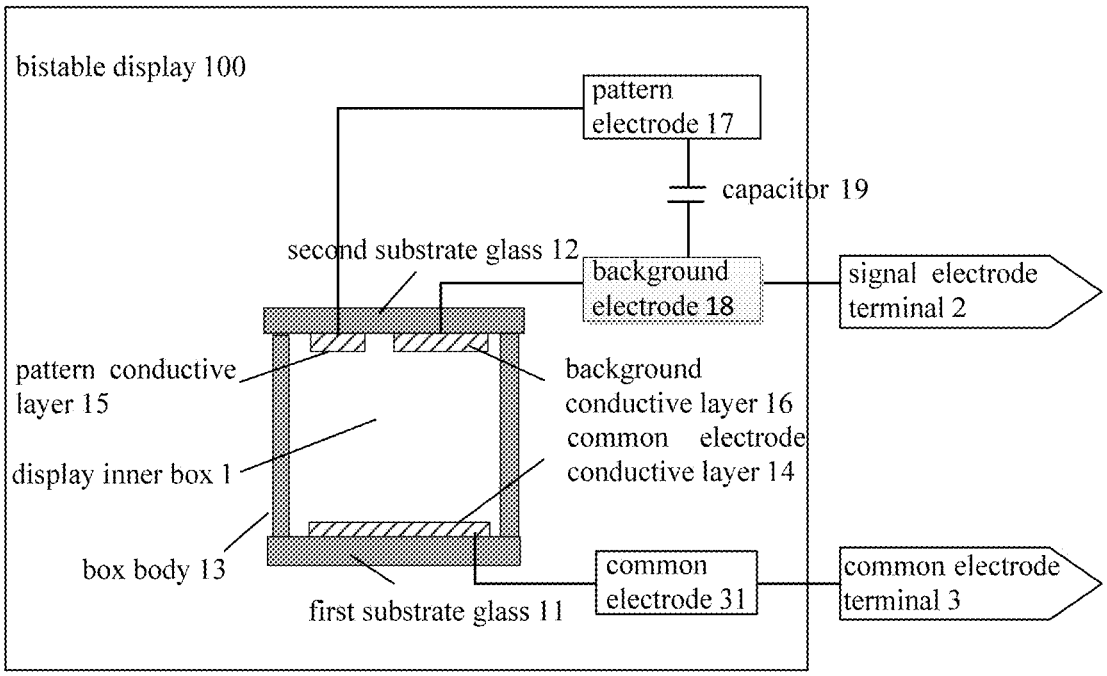
FIG. 2 is a principle block diagram showing a bistable display.
Figure 3:
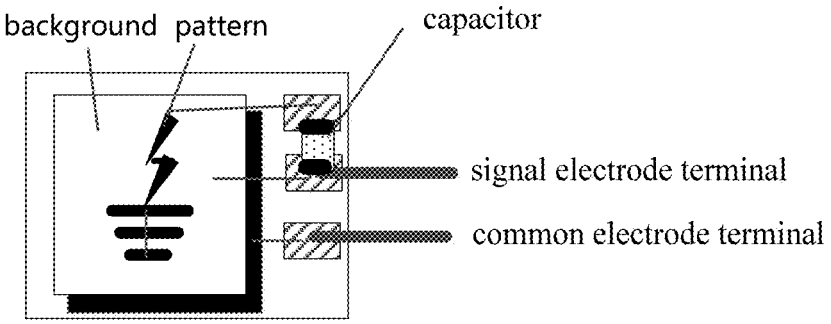
FIG. 3 is a schematic diagram of a concrete bistable display, in which FIG. 3(*a*) is a schematic diagram showing that the display is "bright" and FIG. 3(*b*) is a schematic diagram showing that the display is "dark".
Figure 3:
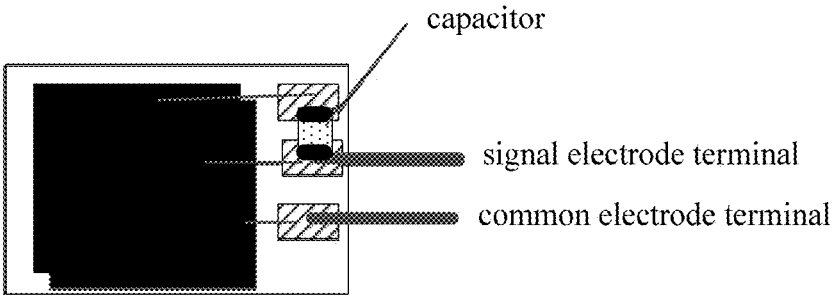

FIG. 2 is a principle block diagram of a bistable display. For ease of understanding, FIG. 3 shows a schematic diagram of a concrete bistable display.

A bistable display 100 is composed of one bistable display inner box 1 and two lead terminals. The two lead terminals are a signal electrode terminal 2 and a common electrode terminal 3 respectively. The bistable display inner box 1 is composed of two substrate glasses, i.e., a first substrate glass 11 and a second substrate glass 12, a box body 13 surrounding a space between the first substrate glass and the second substrate glass, and a bistable display material, constituted of, for example, a bistable liquid crystal or the like, injected into the box. The first substrate glass 1 is plated with a common electrode conductive layer 14, and a common electrode 31 is led out of the box and is connected with a common electrode lead terminal 3. The second substrate glass 12 is plated with a pattern conductive layer 15 and a background conductive layer 16, which are led out of the box as a pattern electrode 17 and a background electrode 18 respectively. As can be seen from FIG. 2, a plate capacitor is formed between the pattern conductive layer 15 and the common electrode conductive layer 14, and between the background conductive layer 16 and the common electrode conductive layer 14, respectively. In the design of FIG. 2, the background electrode 18 is connected with the signal electrode terminal 2, and there is a voltage divider capacitor 19 between the background electrode 18 and the pattern electrode 17.

The working principle of such design is as follows. After one pulse of a high amplitude is input between the signal electrode terminal 2 and the common electrode terminal 3, the voltage amplitude is set as VH (a first voltage) which is greater than a first stable state drive voltage VON of the bistable display. Since the signal electrode terminal 2 is connected with the background electrode 18, the area of the background conductive layer 16 obtains the pulse of the voltage VH and exhibits first stable state display, i.e., a colored reflection state, which produces a "lighted-up" vision under the effect of ambient light. The pattern conductive layer 15 obtains an input voltage through the voltage divider capacitor 19. The voltage divider capacitor 19 is connected in series with the plate capacitor between the pattern conductive layer 15 and the common electrode conductive layer 14. The capacitance of the voltage divider capacitor is appropriately selected such that the pulse voltage VGH of the pattern conductive layer is less than the first stable state drive voltage VON of the display and greater than the second stable state drive voltage VOFF of the display, and thus the area of the pattern conductive layer exhibits second stable state display, i.e., the dark state, and the entire display exhibits the display effect as shown in FIG. 3(*a*). When one pulse of a low amplitude is input between the signal electrode and the common electrode, the voltage amplitude is set as VL (a second voltage) which is less than VON but greater than VOFF, and thus the area of the background conductive layer 16 exhibits second stable state display, i.e., the dark state display. The voltage VGL of the pattern conductive layer 15 is reduced correspondingly due to the series voltage dividing function of the voltage divider capacitor 19, but may still be greater than VOFF (as long as the capacitance of the voltage divider capacitor is selected appropriately, this requirement can be satisfied). As a result, the area of the pattern conductive layer 15 also exhibits second stable state display, i.e., the dark state display, and the entire display exhibit a "darkened" display effect, as shown in FIG. 3(*b*).

Figure 4:
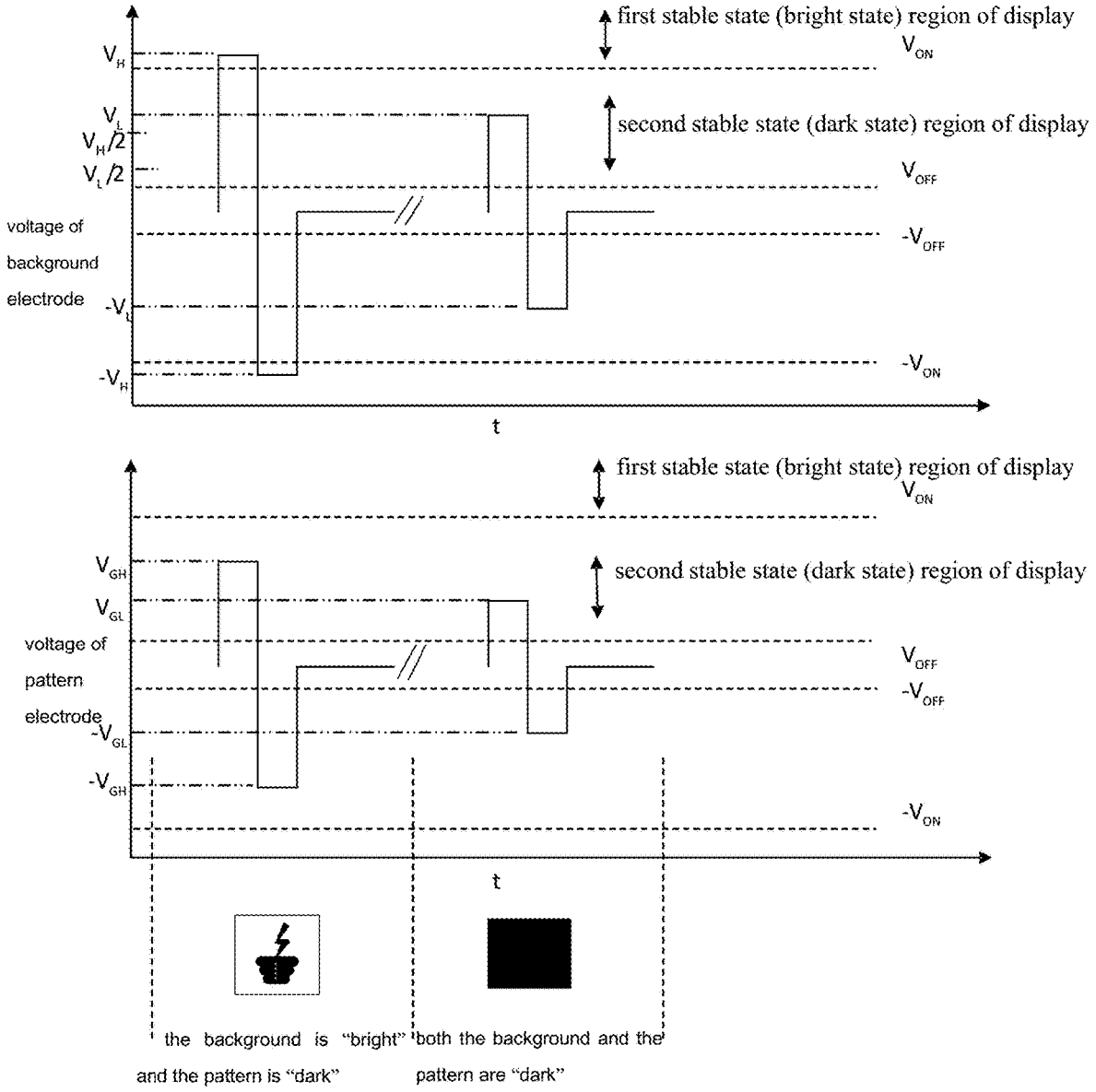
FIG. 4 is a waveform diagram of the first stable state (the bright state) and the second stable state (the dark state) driving voltages of a bistable display.

FIG. 4 is a voltage waveform diagram of the bright state and the dark state of the bistable display, in which the voltage driving characteristics of the bistable display is given. As can be seen from the figure, both the bright state voltage range and the dark state voltage range of the display are relatively wide. As long as VH (the amplitude of the bright state pulse, VH>VON) and VL (the amplitude of the dark state pulse, VOFF<VL<VON) of the input driving signal are appropriately selected such that amplitudes VGH and VGL of the pulse corresponding to the pattern electrode are in the dark state region, that is, VOFF<VGH<VON and VOFF<VGL<VON, a display effect that the background is bright and the pattern is dark can be realized.

In the design of FIG. 2, the signal electrode terminal 2 is connected with the background electrode 18 to produce a display effect that the background is bright and the pattern is dark. In practical applications, the signal electrode terminal 2 may also be connected with the pattern electrode 17 so as to produce a display effect that the pattern is bright and the background is dark.

Second Embodiment

The second embodiment is an embodiment of a voltage divider circuit implementing the driving of the bistable displaying by using internal capacitor method. In the following, the description will be made with reference to FIG. 5.

In the first embodiment, it is described that the voltage divider circuit between electrodes of the display is realized by an external capacitor. We can also use an internal capacitor of the display to realize the voltage divider circuit, that is, the voltage divider capacitor is made inside of the display. The internal plate capacitor is formed by the conductive layers on the two substrate glasses of the inner box of the display, so that the external voltage divider capacitor between the electrodes can be omitted.

Figure 5:
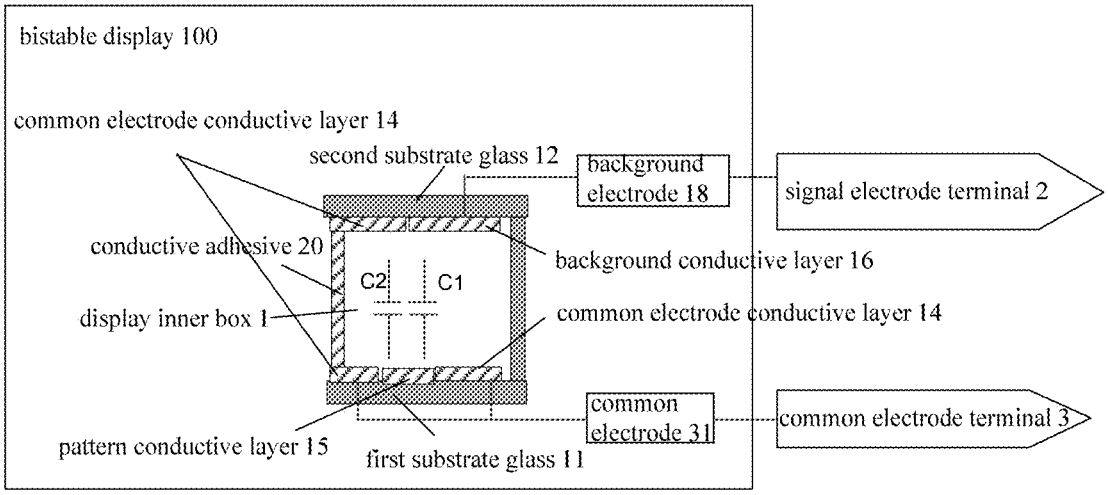
FIG. 5 is a principle diagram of making the voltage divider capacitor inside the display.

FIG. 5 is a principle diagram of a design case where a voltage divider capacitor is made inside the display. In FIG. 5, the pattern conductive layer 15 is made on the first substrate glass 11 such that a part of the area of the pattern conductive layer overlaps with the background conductive layer 16 on the second substrate glass 12 in an up-down manner constituting an equivalent capacitor C1, the remaining part of the area of the pattern conductive layer overlaps with the common electrode conductive layer 14 on the second substrate glass 12 in an up-down manner constituting an equivalent capacitor C2, and the common electrode conductive layer 14 on the second substrate glass 12 and the common electrode conductive layer 14 on the first substrate glass 11 realize the up-down conduction through the conductive adhesive 20 on the frame of the inner box 1 of the display and are both connected to the common electrode 31. In this way, the equivalent capacitor C1 is equivalent to the external voltage divider capacitor in FIG. 2. Between the background electrode and the common electrode, a series circuit is constituted of "the background conductive layer→the equivalent capacitor C1→the pattern conductive layer→the equivalent capacitor C2→the common conductive layer". We can make the equivalent capacitors C1 and C2 substantially equal by adjusting the overlapping area between the pattern conductive layer and the background conductive layer. Thus, when the pulse amplitude of the signal of the background electrode is VH (the first voltage, VH>VON), the pattern conductive layer 15 obtains a pulse signal of a pulse amplitude VGH=VH/2 due to the series voltage dividing function of C1 and C2. It can be seen from FIG. 4 that VH is appropriately selected such that VOFF<VGH<VON, and thus the background is in the first stable state display, i.e., the bright state, and the pattern is in the second stable state display, i.e., the dark state. When the pulse amplitude of the signal of the background electrode is VL (the second voltage, VOFF<VL<VON), the pattern conductive layer 15 obtains a pulse signal of a pulse amplitude VGL=VL/2 due to the series voltage dividing function of C1 and C2. VL is appropriately selected such that VOFF<VGL<VON, and thus both the background and the pattern are in the second stable state display, i.e., the dark state, thereby a display effect that the indicator light is extinguished is achieved.

Third Embodiment

The third embodiment is an embodiment of a voltage divider circuit implementing the driving of the bistable displaying by using voltage divider resistor method. In the following, the description will be made with reference to FIG. 6.

In addition to implementing a voltage division driver circuit by bridging an external capacitor between the pattern electrode and the background electrode, other electronic elements may also be bridged between the pattern electrode, the background electrode and the common electrode to play a role in voltage dividing, so as to achieve the same purpose of the present disclosure.

Figure 6:
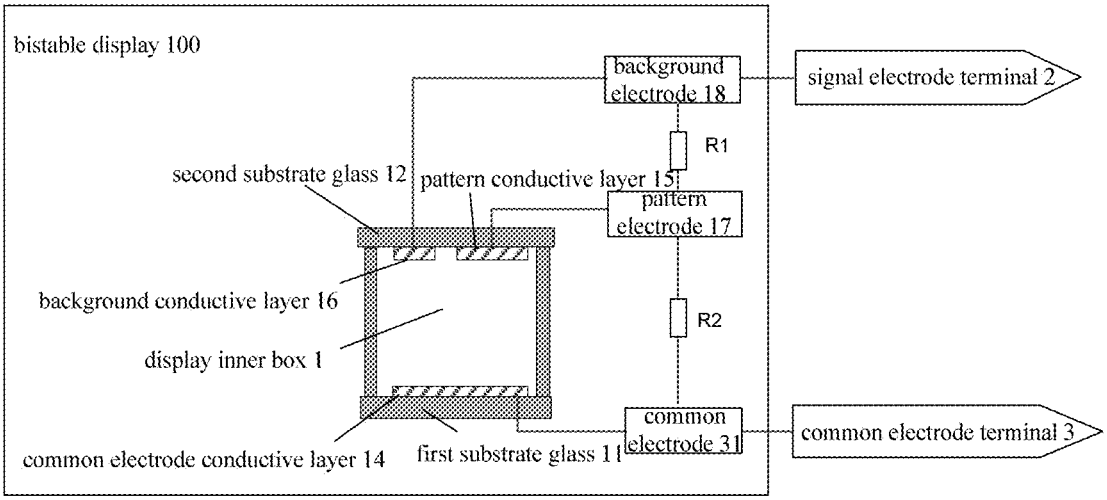
FIG. 6 is a principle diagram of a dual-electrode driving that uses a voltage divider resistor to realize a bistable pattern display.

FIG. 6 is a principle diagram of a dual-electrode driving that uses a voltage divider resistor to realize a bistable pattern display. As shown in FIG. 6, the common electrode conductive layer 14 is formed on the first substrate glass 11, and the pattern conductive layer 15 and the background conductive layer 16 are formed on the second substrate glass 12.

In FIG. 6, the voltage divider resistor method is employed to make the pattern electrode obtain a pulse signal of a low voltage amplitude. A resistor R1 is bridged between the background electrode 18 and the pattern electrode 17, and a resistor R2 is bridged between the pattern electrode 17 and the common electrode 31. When the driving signal (it is assumed that the amplitude is the first voltage VH, VH>VON, or the second voltage VL, VOFF<VL<VON) is input to the signal electrode terminal 2, the pattern electrode 17 obtains the driving signal of a low amplitude through the voltage divider resistors R1 and R2. Appropriate values of R1 and R2 are selected such that the amplitudes VGH and VGL (corresponding to VH and VL, respectively) of the signal on the pattern electrode 17 satisfy the following inequalities: VOFF<VG<VH and VOFF<VGL<VON, thereby it can be achieved that the pattern is in the dark state while the background is lighted up.

The bridged resistor in FIG. 6 may be an external resistor or may be a resistor formed by the internal wiring of the display.

Fourth Embodiment

The fourth embodiment is an embodiment of a voltage divider circuit implementing the driving of the bistable displaying by using voltage regulator tube method. In the following, the description will be made with reference to FIG. 7.

Figure 7:
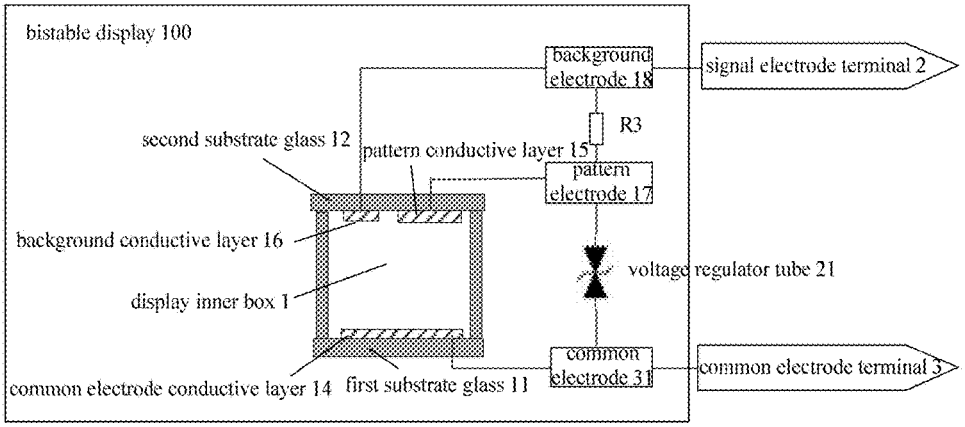
FIG. 7 is a principle diagram of a dual-electrode driving that uses a voltage regulator tube to realize a bistable pattern display.

FIG. 7 is a principle diagram of using voltage regulator tube method to realize the voltage division driving.

As shown in FIG. 7, the common electrode conductive layer 14 is formed on the first substrate glass 11, and the pattern conductive layer 15 and the background conductive layer 16 are formed on the second substrate glass 12. A resistor R3 is bridged between the background electrode 18 and the pattern electrode 17, and a voltage regulator tube 21 is bridged between the pattern electrode 17 and the common electrode 31. Due to the voltage stabilizing function of the voltage regulator tube 21, the voltage of the pattern electrode 17 can be fixed at a certain dark state voltage, for example VL. When the amplitude of the input pulse is the first voltage VH, VH>VON>VL, and the background is in the bright state, while pattern electrode 17 is subject to the voltage regulator tube 21, and its voltage amplitude is limited to VL, thereby the pattern display area is in the dark state. When the amplitude of the input pulse is VL, VOFF<VL<VON, the pulse amplitudes of the signals of the background electrode and the pattern electrode are both the second voltage VL, and the background and pattern display areas are both in the dark state. The advantage of using a voltage regulator tube is that when the display is in the dark state, since pulse amplitudes of the background and pattern electrodes are the same, the background and the pattern exhibit the dark state of the same color and no chromatic aberration is caused, achieving an ideal display effect.

Fifth Embodiment

The fifth embodiment is an embodiment of a voltage divider circuit implementing the bistable displaying of multiple patterns by using multi-level signal driving method. In the following, the description will be made with reference to FIG. 8.

Figure 8:
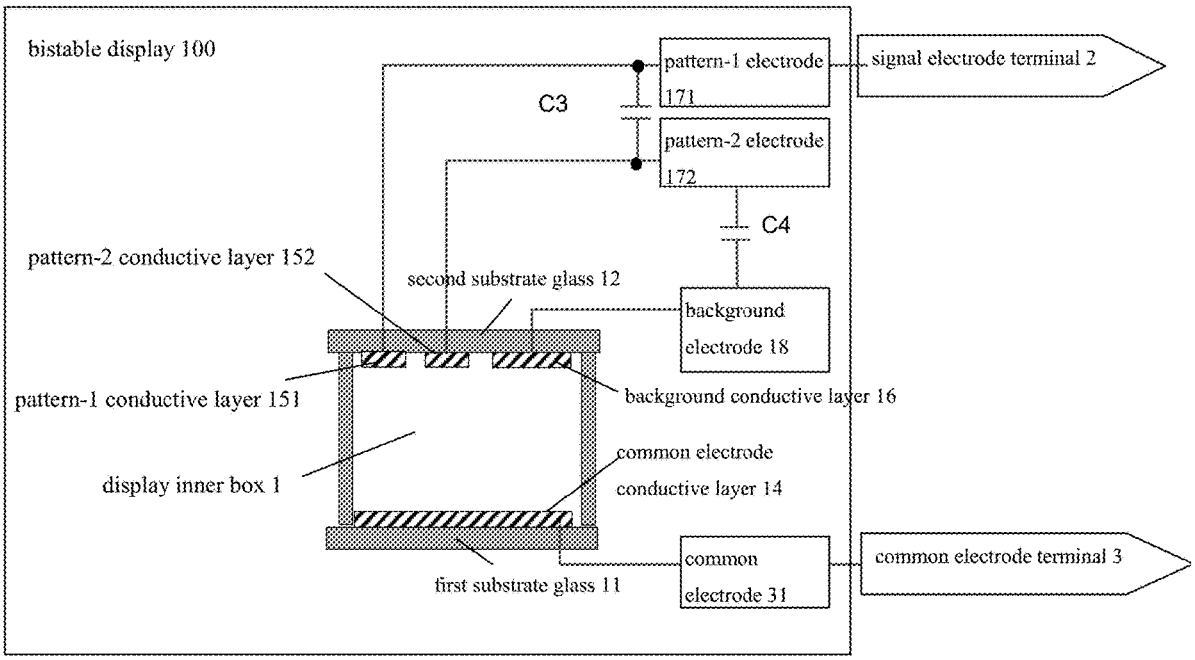
FIG. 8 is a principle diagram of a bistable display driven by two pattern segment voltages.

As an extension of the present disclosure, the design of a bistable display of two or more patterns can be implemented using the same principle. FIG. 8 is a principle block diagram of a bistable display driven by two pattern segment voltages.

A design case of using dual electrodes to drive two bistable patterns will now be described by taking FIG. 8 as an example. There are two patterns in the display in FIG. 8, which corresponds to a pattern-1 electrode 171 and a pattern-2 electrode 172, respectively. An external capacitor C3 is bridged between the two pattern electrodes, and an external capacitor C4 is bridged between the pattern-2 electrode 172 and the background electrode 18. A multi-level pulse voltage driving method is used on the signal electrode terminal 2. In this example, three levels of pulse amplitudes of the signal, namely VH1 (the first voltage), VH2 (the third voltage), and VL (the second voltage) respectively, are used to satisfy inequalities:

$$VH1>VH2>VON,$$

$$VOFF<VL<VON.$$

The driving signal is transmitted to the pattern-2 electrode 172 through the capacitor C3. Due to the voltage dividing function of the capacitor, the pulse amplitude of the signal obtained on the pattern-2 electrode 172 is VG1, VG2 (corresponding to VH1, VH2 respectively). The driving signal on the pattern-2 electrode 172 is also transmitted to the background electrode 18 through the capacitor C4, so that the pulse amplitude of the signal on the background electrode 18 becomes VB1, VB2 (corresponding to VG1, VG2 respectively). Appropriate capacitances of C1 and C2 is selected to satisfy the following inequalities:

$$VG1>VON,$$

$$VOFF<VGL<VG2<VON,$$

$$VOFF<VBL<VB2<VB1<VON.$$

Figure 9:
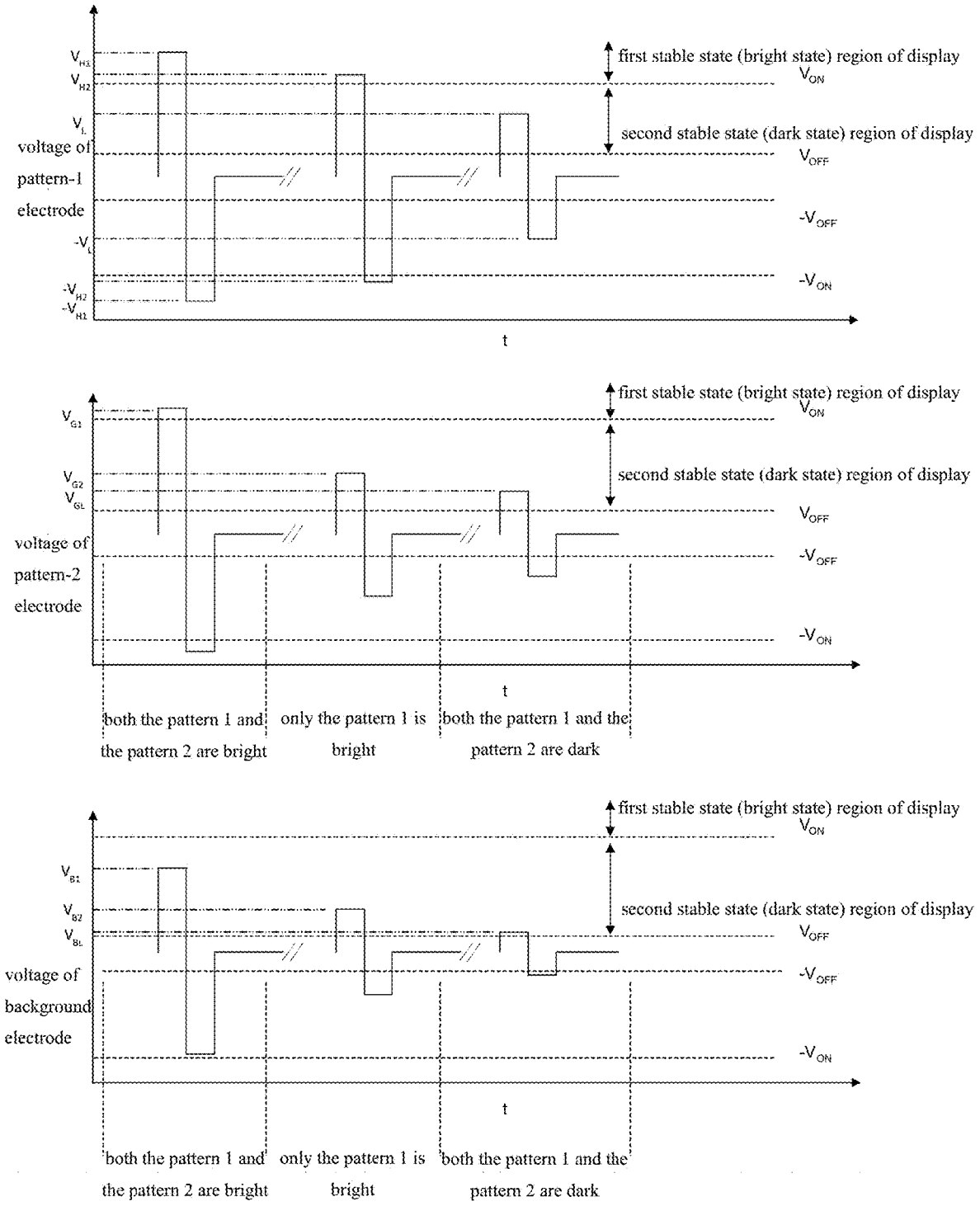
FIG. 9 is a waveform schematic diagram of an electrode signal driven by two pattern segment voltages.

FIG. 9 is a waveform schematic diagram of an electrode signal driven by two pattern segment voltages. The signal waveforms that satisfy the above inequalities are shown in FIG. 9. In this way, when the amplitude of the input pulse signal is VH1, the pattern 1 and the pattern 2 are simultaneously in the bright state while the background is in the dark state; when the amplitude of the input pulse signal is VH2, only the pattern 1 is in the bright state, and the pattern 2 and the background are in the dark state; when the amplitude of the input pulse signal is VL, the pattern 1, the pattern 2 and the background are all in the dark state because VL<VON. In this way, the purpose of using two electrodes to drive multiple bistable patterns is achieved. The design of FIG. 8 is just one example of implementing the dual-electrode driving using this kind of method. Various similar designs all belong to the protection scope of the present disclosure.

In the following, a flowchart of a driving method of a bistable display is explained with reference to FIG. 10 and FIG. 11.

Figure 10:
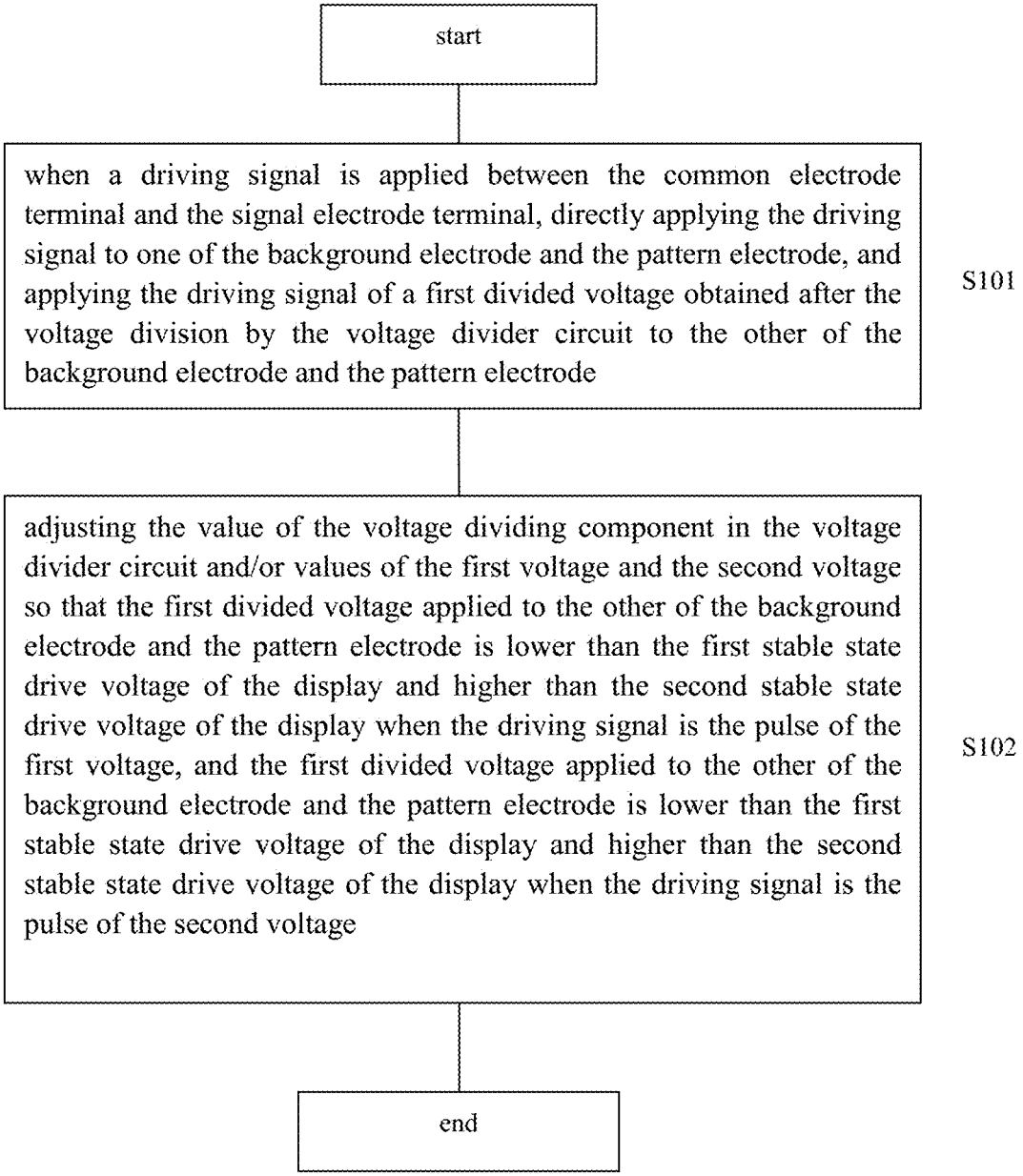
FIG. 10 is a flowchart showing an example of a driving method of a bistable display.

FIG. 10 is a flowchart showing an example of a driving method of a bistable display. The driving method is applicable to the bistable displays in the first to fourth embodiments as described above.

First, in step S101, when a driving signal is applied between the common electrode terminal and the signal electrode terminal, the driving signal is directly applied to one of the background electrode and the pattern electrode, and the driving signal of a first divided voltage obtained after the voltage division by the voltage divider circuit is applied to the other one of the background electrode and the pattern electrode.

Then, the value of the voltage dividing component in the voltage divider circuit and/or values of high amplitude pulse and low amplitude pulse are adjusted so that the first divided voltage applied to the other one of the background electrode and the pattern electrode is lower than the first stable state drive voltage of the display and higher than the second stable state drive voltage of the display when the driving signal is high amplitude pulse, and the first divided voltage applied to the other one of the background electrode and the pattern electrode is lower than the first stable state drive voltage of the display and higher than the second stable state drive voltage of the display when the driving signal is the pulse of the second voltage.

The above driving method of the bistable display according to the present disclosure may provide suitable voltages for respective electrodes by combining the voltage divider circuit and the voltage adjustment range of the driving signal.

Figure 11:
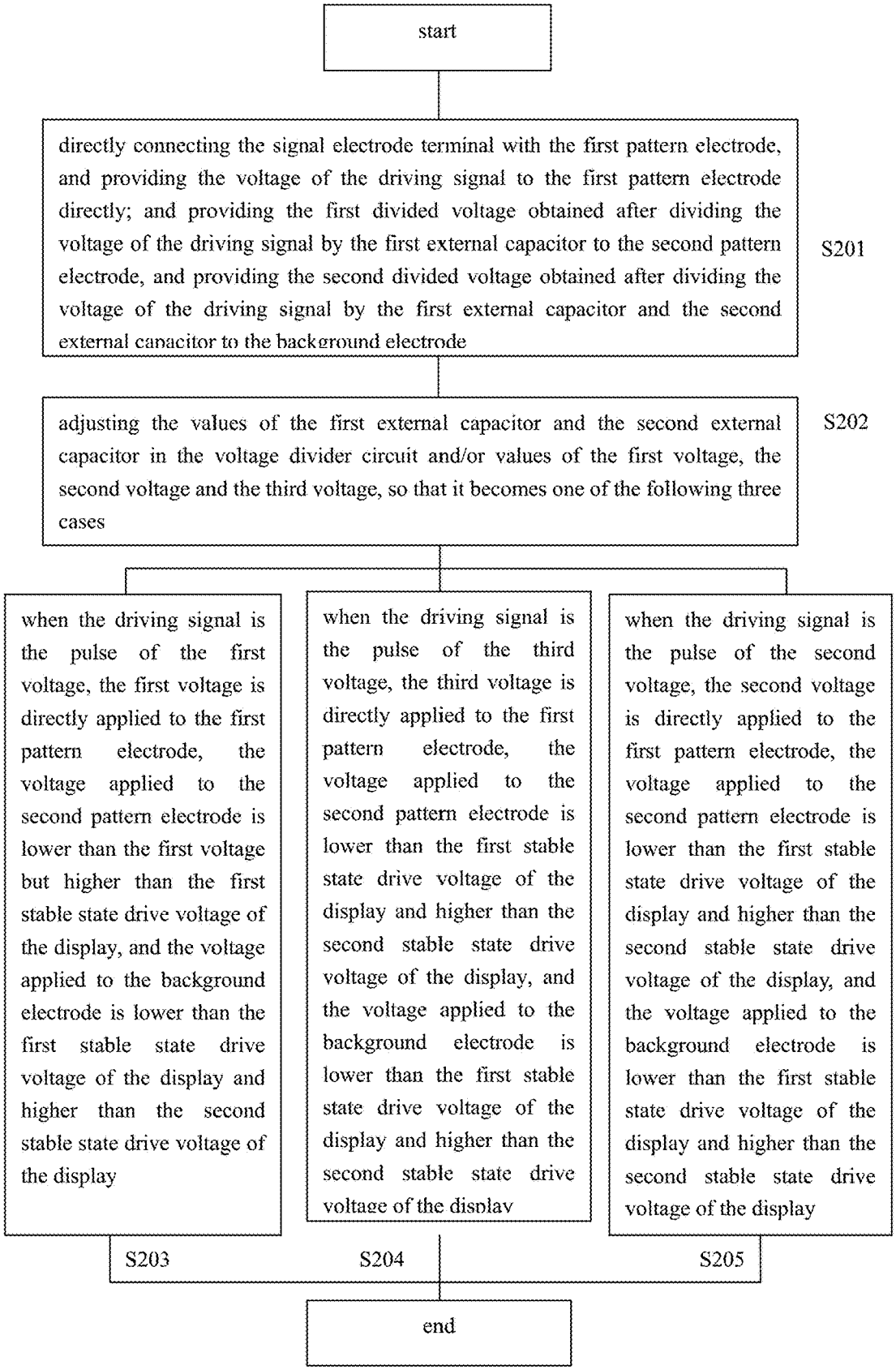
FIG. 11 is a flowchart showing another example of a driving method of a bistable display.

FIG. 11 is a flowchart showing another example of a driving method of a bistable display. The above flowchart is applicable to the bistable display of the fifth embodiment.

First, in step S201, the signal electrode terminal is directly connected with the first pattern electrode, and the voltage of the driving signal is provided to the first pattern electrode directly; and the first divided voltage obtained after dividing the voltage of the driving signal by the first external capacitor is provided to the second pattern electrode, and the second divided voltage obtained after dividing the voltage of the driving signal by the first external capacitor and the second external capacitor is provided to the background electrode.

Then, the values of the first external capacitor and the second external capacitor in the voltage divider circuit is adjusted while dividing the voltage amplitude of the driving signal into 3 levels or more, and in a case that the voltage amplitude is of 3 levels, they are set as the first voltage, a third voltage and the second voltage respectively in the descending order with the third voltage being less than the first voltage and greater than the first stable state drive voltage of the display, so that it becomes one of the following three cases:

S203: when the driving signal is the pulse of the first voltage, the first voltage is directly applied to the first pattern electrode, the voltage applied to the second pattern electrode is lower than the first voltage but higher than the first stable state drive voltage of the display, and the voltage applied to the background electrode is lower than the first stable state drive voltage of the display and higher than the second stable state drive voltage of the display.

S204: when the driving signal is the pulse of the third voltage, the third voltage is directly applied to the first pattern electrode, the voltage applied to the second pattern electrode is lower than the first stable state drive voltage of the display and higher than the second stable state drive voltage of the display, and the voltage applied to the background electrode is lower than the first stable state drive voltage of the display and higher than the second stable state drive voltage of the display.

S205: when the driving signal is the pulse of the second voltage, the second voltage is directly applied to the first pattern electrode, the voltage applied to the second pattern electrode is lower than the first stable state drive voltage of the display and higher than the second stable state drive voltage of the display, and the voltage applied to the background electrode is lower than the first stable state drive voltage of the display and higher than the second stable state drive voltage of the display.

Due to providing the driving signal after being divided by using the voltage divider circuit formed in many ways to respective electrodes, the above driving method of the bistable display according to the present disclosure may produce many kinds of display effects by using one driving signal and realize the display of two or more bistable patterns.

The connection relationships and the constituent relationships of the respective units (functional modules, chips, etc.) in various embodiments of the present disclosure do not limit the protection scope of the present disclosure, and they may be implemented by being combined into a single unit, or specific units thereof may also be implemented by being divided into multiple units of smaller functionality.

Each block diagram in the attached drawings shows the structure, function, and operation that may be implemented by a PLC apparatus according to an embodiment of the present disclosure. In this regard, each block in the block diagram may represent a module that includes one or more executable instructions for implementing specified logical functions. In alternative implementations, the functions denoted in the blocks may also occur in a different order than that denoted in the attached drawings. For example, two consecutive blocks may actually be performed substantially in parallel, and they may sometimes be performed in the reverse order, depending on the function involved. It should also be noted that each block in the block diagram may be implemented with a dedicated hardware-based ASIC that performs a specified function or action, or may be implemented with a combination of dedicated hardware and computer instructions.

Various embodiments of the present disclosure have been described above, and the above description is exemplary, not exhaustive, and is not limited to the various embodiments disclosed. Many modifications and variations will be apparent to those of ordinary skill in the art without departing from the scope and spirit of the various embodiments described. The choice of terminology used herein is intended to best explain the principles of the various embodiments, the practical applications or improvements of techniques in the market, or to enable others of ordinary skill in the art to understand the various embodiments disclosed herein.

INDUSTRIAL APPLICABILITY

The electronic design of the bistable display allows the display to display a specific pattern while still keeping the two electrodes led out of the display without the need to print a pattern on the surface of the display, so as to improve the visual display effect and the reliability of the display.

DESCRIPTION OF REFERENCE NUMERALS

100 bistable display
1 display inner box
2 signal electrode terminal
3 common electrode terminal
11 first substrate glass
12 second substrate glass
13 box body
14 common electrode conductive layer
15 pattern conductive layer
16 background conductive layer
17 pattern electrode
18 background electrode
19 capacitor
20 conductive adhesive
21 voltage regulator tube
31 common electrode
151 pattern-1 conductive layer
152 pattern-2 conductive layer
171 pattern-1 electrode
172 pattern-2 electrode
C1, C2, C3, C4 capacitor
R1, R2, R3 resistor

What is claimed is:

1. A bistable display, comprising:

an inner box constituted of a first substrate, a second substrate and a box body surrounding a space between the first substrate and the second substrate, wherein a bistable display material is injected into the space, and one or more of a common electrode conductive layer, a pattern conductive layer, and a background conductive layer are respectively formed on the first substrate and/or the second substrate inside the inner box, the common electrode conductive layer is led out of the inner box through a common electrode, the pattern conductive layer is led out of the inner box through a pattern electrode, and the background conductive layer is led out of the inner box through a background electrode, a common electrode terminal connected with the common electrode; and a signal electrode terminal connected with the background electrode and/or the patter electrode, wherein a driving signal including a pulse of a first voltage higher than a first stable state drive voltage of the display and a pulse of a second voltage lower than the first stable state drive voltage of the display and higher than a second stable state drive voltage of the display is applied between the common electrode terminal and the signal electrode terminal, the background electrode, the pattern electrode and the common electrode are connected in series between the signal electrode terminal and the common electrode terminal through a voltage dividing component to form a voltage divider circuit, the voltage dividing component is comprised of one or more of an external capacitor, an internal capacitor, a resistor, and a voltage regulator tube, when a driving signal is applied between the common electrode terminal and the signal electrode terminal, the driving signal is directly applied to one of the background electrode and the pattern electrode, and the driving signal of a first divided voltage obtained after the voltage division by the voltage divider circuit is applied to the other one of the background electrode and the pattern electrode, the value of the voltage dividing component in the voltage divider circuit and/or values of the first voltage and the second voltage are adjusted so that the first divided voltage applied to the other one of the background electrode and the pattern electrode is lower than the first stable state drive voltage of the display and higher than the second stable state drive voltage of the display when the driving signal is the pulse of the first voltage, and the first divided voltage applied to the other one of the background electrode and the pattern electrode is also lower than the first stable state drive voltage of the display and higher than the second stable state drive voltage of the display when the driving signal is the pulse of the second voltage.

2. The bistable display according to claim 1, wherein the common electrode conductive layer is formed on the glass of the first substrate, and the pattern conductive layer and the background conductive layer are formed on the glass of the second substrate, the voltage divider circuit is formed by connecting a voltage divider capacitor connected between the background electrode and the pattern electrode and a plate capacitor formed between the pattern electrode and the common electrode in series, the signal electrode terminal is directly connected with the background electrode and provides the voltage of the driving signal to the background electrode; and the signal electrode terminal is indirectly connected with the pattern electrode through the voltage divider capacitor and provides the first divided voltage to the pattern electrode.

3. The bistable display according to claim 1, wherein the pattern conductive layer is formed on the glass of the first substrate so that a part of the area of the pattern conductive layer overlaps with the background conductive layer formed on the glass of the second substrate in an up-down manner constituting a first equivalent capacitor, the remaining part of the area of the pattern conductive layer overlaps with the common electrode conductive layer formed on the glass of the second substrate in an up-down manner constituting a second equivalent capacitor, and the common electrode conductive layer on the glass of the second substrate and the common electrode conductive layer on the glass of the first substrate realize the up-down conduction through the conductive adhesive on the frame of the inner box of the display and are both connected with the common electrode, the voltage divider circuit is formed by connecting the first equivalent capacitor between the background conductive layer and the pattern conductive layer and the second equivalent capacitor between the pattern conductive layer and the common conductive layer in series.

4. The bistable display according to claim 1, wherein the common electrode conductive layer is formed on the glass of the first substrate, and the pattern conductive layer and the background conductive layer are formed on the glass of the second substrate, the voltage divider circuit is formed by connecting a first resistor bridged between the background electrode and the pattern electrode and a second resistor bridged between the pattern electrode and the common electrode in series.

5. The bistable display according to claim 1, wherein the common electrode conductive layer is formed on the glass of the first substrate, and the pattern conductive layer and the background conductive layer are formed on the glass of the second substrate, the voltage divider circuit is formed by connecting a third resistor bridged between the background electrode and the pattern electrode and a voltage regulator tube bridged between the pattern electrode and the common electrode in series.

6. The bistable display according to claim 1, wherein a first pattern conductive layer and a second pattern conductive layer are formed on the glass of the second substrate, the first pattern conductive layer being connected with a first pattern electrode and the second pattern conductive layer being connected with a second pattern electrode, the voltage divider circuit is formed by connecting a first external capacitor bridged between the first pattern electrode and the second pattern electrode, a second external capacitor bridged between the second pattern electrode and the background electrode, and a plate capacitor formed between the background electrode and the common electrode in series, the signal electrode terminal is directly connected with the first pattern electrode, and provides the voltage of the driving signal to the first pattern electrode; and the first divided voltage obtained after dividing the voltage of the driving signal by the first external capacitor is provided to the second pattern electrode, and the second divided voltage obtained after dividing the voltage of the driving signal by the first external capacitor and the second external capacitor is provided to the background electrode, the values of the first external capacitor and the second external capacitor in the voltage divider circuit are adjusted while dividing the voltage amplitude of the driving signal into 3 levels or more, and in a case that the voltage amplitude is of 3 levels, they are set as a first voltage, a third voltage and a second voltage respectively in the descending order with the third voltage being less than the first voltage and greater than the first stable state drive voltage of the display, so that it becomes one of the following three cases:

when the driving signal is the pulse of the first voltage, the first voltage is directly applied to the first pattern electrode, the voltage applied to the second pattern electrode is lower than the first voltage but higher than the first stable state drive voltage of the display, and the voltage applied to the background electrode is lower than the first stable state drive voltage of the display and higher than the second stable state drive voltage of the display;

when the driving signal is the pulse of the third voltage, the third voltage is directly applied to the first pattern electrode, the voltage applied to the second pattern electrode is lower than the first stable state drive voltage of the display and higher than the second stable state drive voltage of the display, and the voltage applied to the background electrode is lower than the first stable state drive voltage of the display and higher than the second stable state drive voltage of the display; or when the driving signal is the pulse of the second voltage, the second voltage is directly applied to the first pattern electrode, the voltage applied to the second pattern electrode is lower than the first stable state drive voltage of the display and higher than the second stable state drive voltage of the display, and the voltage applied to the background electrode is lower than the first stable state drive voltage of the display and higher than the second stable state drive voltage of the display.

* * * * *